United States Patent [19]

Tanaka et al.

[11] 4,246,332

[45] Jan. 20, 1981

[54] ELECTROPHOTOGRAPHIC TONER COMPRISING LOW AND HIGH MOLECULAR WEIGHT BLEND OF BINDER RESINS

[75] Inventors: Koichi Tanaka; Kenji Kobayashi; Shigeo Aonuma, all of Minami-ashigara, Japan

[73] Assignee: Fuji Xerox Co., Ltd., Tokyo, Japan

[21] Appl. No.: 15,840

[22] Filed: Feb. 27, 1979

[30] Foreign Application Priority Data

Feb. 27, 1978 [JP] Japan ..... 53-20897

[51] Int. Cl.[3] ..... G03G 11/00

[52] U.S. Cl. ..... 430/109; 430/110; 430/124

[58] Field of Search ..... 252/62.1; 430/109, 110, 430/124

[56] References Cited

U.S. PATENT DOCUMENTS 3,965,021 6/1976 Clemens et al. ..... 252/62.1

*Primary Examiner*—John D. Welsh

*Attorney, Agent, or Firm*—Sughrue, Rothwell, Mion, Zinn and Macpeak

[57] ABSTRACT

An electrophotographic toner comprising a binder resin and a colorant dispersed therein wherein the binder resin comprises about 50 to 95% by weight of a low temperature melting, high fluidity resin having a number average molecular weight of about 1,000 to 4,000, a glass transition temperature of about 40° to 60° C. and a melt index at 110° C. of about 50 to 200 g/10 min or a mixture thereof, and about 5 to 50% by weight of a high molecular weight polymer having a glass transition temperature of about 35° to 60° C. and a weight average molecular weight of more than about 500,000.

11 Claims, No Drawings

ELECTROPHOTOGRAPHIC TONER COMPRISING LOW AND HIGH MOLECULAR WEIGHT BLEND OF BINDER RESINS

BACKGROUND OF THE INVENTION

1. Field of the Invention

This invention relates to an electrophotographic toner.

2. Description of the Prior Art

Various electrophotographic processes have hitherto been known as described, for example, in U.S. Pat. No. 2,297,691, Japanese Patent Publication Nos. 23910/1967, 24748/1968, etc. In general, an electrostatic latent image is formed on a light-sensitive member by various procedures utilizing a photoconductive material and developing with a toner, and the Procedures for developing an electrostatic latent image using toners include the magnetic brush process described in U.S. Pat. No. 2,874,063, the cascade developing process described in U.S. Pat. No. 2,618,552, the powdery mica process described in U.S. Pat. No. 2,221,776, etc. In any of these procedures, the step of fixing the toner image is, as a matter of course, essential.

In heat roll fixing equipment, the toner image comes into contact with the heat rolls in the molten state and as a result a part of the toner image attaches to the surface of the heat rolls and is transferred thereto. This phenomenon is the so-called offset phenomenon. As a result, the toners employed in a high speed copying apparatus in which the heat roll fixing equipment is used must be made such that they are free from offset.

More difficult problems are encountered in producing offset-free toners which are to be applied to a high speed copying apparatus in which heat rolls are used and not much electric power is used, i.e., so-called power saving high speed copying apparatuses.

Binder resins for use in the production of offset-free toners are required to be as tough as possible. To meet this requirement, high molecular weight polymers are usually employed. However, in order to provide these high molecular weight polymers with sufficient melt-fluidity, the toners must be heated to considerably high temperatures, which conflicts with the requirement of power-savings. Thus, in order to save power or energy, the toners should be fixable at low temperatures. In order to make the toners fluid even at low temperatures to meet the above requirement, it is desirable to employ resins having as low molecular weights as possible as well as low glass transition points. Such low molecular weight resins, however, are naturally insufficient in toughness and therefore offset is liable to take place.

Increasing the toughness of the toners in order to prevent offset has hitherto been achieved by employing high molecular weight polymers having a weight average molecular weight of more than about 100,000. As such high molecular weight polymers, vinyl based polymers are often used because vinyl based polymers having such high molecular weights can be easily produced by conventional free radical polymerization. In order to be able to fix these high molecular weight vinyl based polymer-containing toners at low temperatures, the glass transition point of the polymers has been reduced to as low levels as possible within the range that no blocking takes place, the fixing temperature has been reduced by adding a plasticizer, or other modifications have had to be made.

The above techniques, however, not only decrease the fixing point (i.e., the lowest temperature at which the fixation is completely conducted), but also decrease the hot offset temperature (i.e., the temperature at which the offset begins to take place), and thus merely shift the temperature range between the fixing point and the hot offset temperature (the so-called fusing latitude) to the low temperature side. This leads to the formation of a new problem that offset and streaks often occur due to the instability of the toners. Thus the advantage of lowering the fixing temperature is for naught. In the case that the glass transition point of the polymer is reduced or a plasticizer is added in anticipation of a decrease in the hot offset temperature, if the decrease in the fixing temperature brought about by these procedures is compensated by an increase of the weight average molecular weight, the decrease in hot offset temperature can be prevented. However, an increase in viscosity due to an increase in the molecular weight reduces the effects of the reduction in glass transition point, the addition of plasticizers, etc., and thus the fixing temperature is insufficiently lowered.

On the other hand, condensation type resins such as polyester resins and epoxy resins have low glass transition points unlike vinyl based polymers and furthermore it is possible low molecular weight condensation type resins are more easily formed. This means that the use of such condensation type resins permits easy formation of low temperature fixable toners.

With these resins, however, the offset phenomenon vigorously takes place because they are low molecular weight resins, and thus they cannot be used in toners for heat rolls. It is surprising that the elastic properties in the molten state, which are needed to prevent offset, cannot be obtained even by increasing the molecular weight of the polyester or epoxy resin. In addition, unfavorable problems occur in that only the toughness in the solid state is increased and the pulverization step, where after being molten-mixed with a colorant, the resin is pulverized to form toners, becomes quite difficult. For the above reasons the toners used with heat roll fixing equipment have not used the polyester or epoxy based resins.

On the other hand, when a mixture of toners and carriers is used as a developer, the toners alone separate from the developer mixture and participate directly in development in any of the cascade process and the magnetic brush process. In this case, the efficiency of developing an electrostatic latent image on a drum and the efficiency of transferring the so developed toner image to paper or other medium are quite important to the toners. In order to improve the developing efficiency and the transferring efficiency, charging controllers have often been used. In this case, if the charging controllers are not uniformly dispersed in the toners, the desired effect cannot be obtained or the toner quality becomes unstable. In the case of polyester or epoxy resins into which it is possible to introduce functional groups capable of acting as charging controllers, the problem of the dispersibility of the charging controllers can be avoided.

Owing to these properties, many of the toners prepared using the polyester or epoxy based resins exhibit excellent developing characteristics. As a matter of course, the introduction of functional groups having a charge controlling action into the side chains of the vinyl based polymers enables them to exhibit excellent developing characteristics like the polyester or epoxy resins.

Styrene based polymers have the defects that they have low glass transition points as compared with the polyester or epoxy resins and that it is difficult to produce low molecular weight styrene based polymers.

It is quite difficult to obtain low temperature melting materials which are equal to the polyester or epoxy resins in their developing characteristics. From the above description, it will be apparent that it has been desired to produce those toners in which the excellent low temperature fixability and the developing characteristics of the polyester or epoxy resins are present and which are free from offset to the high temperature at which tones formed from high molecular weight vinyl polymers are also free from offset.

Furthermore, it will be apparent that if it were possible to produce low temperature melting materials, which are as good as the polyester or epoxy resins, from vinyl based polymers containing functional groups having a charge controlling action, it would be desirable to produce those toners for use with heat roll equipment without losing their low temperature fixability and developing characteristics.

SUMMARY OF THE INVENTION

Accordingly, the principal object of this invention is to provide toners having both the property of a toner prepared only from a vinyl based polymer having a sufficiently high molecular weight, i.e., the property that no offset occurs until high temperatures; and the property of a toner prepared only from a polyester or epoxy resin having a sufficiently low molecular weight and a low glass transition point, or from a vinyl polymer containing functional groups having charge controlling action, i.e., the property of excellent low temperature fixability and developing characteristics.

The above object is attained by combining a low temperature melting, high fluidity polyester resin, epoxy resin or vinyl based polymer containing functional groups having the charge controlling action which has a number average molecular weight of about 1,000 to 4,000, a glass transition point of about 40° to 60° C. and a melt index at 110° C. of about 50 to 200 g/10 min (measured according to ASTM D 1238: load: 2,160 g; inner diameter of orifice: 2.0955±0.0051 mm; length: 8.000±0.025 mm) with a high molecular weight polymer having a glass transition point of about 35° to 60° C. and a weight average molecular weight of more than about 500,000 in such a proportion that the low temperature melting, high fluidity resin constitutes about 50 to 95% of the resulting mixture, i.e., toner.

DETAILED DESCRIPTION OF THE INVENTION

When the content of the low temperature melting, high fluidity resin is less than 50%, although heat roll fixation utilizes the so-called non-Newtonian fluidity of a polymer melt (i.e., the property that the viscosity markedly decreases under high shear action), the viscosity under low shear action is so high that the fluidity is not increased even under high shear action and the fixability is deteriorated. On the other hand, when the content of the high molecular weight polymer is less than 5%, the offset undesirably often takes place.

With the toners comprising 5 to 95% by weight of the low temperature melting, high fluidity resin and 5 to 50% by weight of the high molecular weight polymer having a weight average molecular weight of more than 500,000 (i.e., mainly comprising the so-called markedly low molecular weight component) substantially only the excellent fluidity of the markedly low molecular weight component is exhibited under the high shear action and thus it is possible to fix at as low temperatures as the toner comprising only the markedly low molecular weight component, and when the toner is released from the pressure of the heat rolls after the heat pressure fixing process is completed, the high molecular weight component, which is present as a minor component under the conditions that no shear strength is applied, is in such a state that it loosely wraps the whole of the toner in a net and thus the elastic properties are exhibited, preventing the offset.

Polyester resins which are used in preparing the low temperature melting, high fluidity resin used in this invention comprise divalent alcohols as shown in Group A and dibasic acids as shown in Group B, and in addition, trivalent alcohols or carboxylic acids as shown in Group C can be added as a third component.

Group A: ethyleneglycol, triethyleneglycol, 1,2-propyleneglycol, 1,3-propyleneglycol, 1,4-butanediol, neopentylglycol, 1,4-butenediol, 1,4-bis(hydroxymethyl) cyclohexane, bisphenol A, hydrogenated bisphenol A, polyoxyethylenated bisphenol A Group B: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, or acid anhydrides or lower alcohol esters thereof Group C: trivalent or polyvalent alcohols such as glycerin, trimethylolpropane, pentaerythritol and the like, trivalent or polyvalent carboxylic acids such as trimellitic acid, pyromellitic acid and the like.

Epoxy resins used in the preparation of the low temperature melting, high fluidity resin of this invention are most typically those comprising bisphenol A and epichlorohydrine.

Vinyl polymers having the charge controlling action which are used in preparation of the toner of this invention are those comprising functional group-containing monomers as shown in Group D and monomers copolymerizable with the monomers of Group D as shown in Group E, and these vinyl polymers may contain as a third component acrylates and methacrylates as shown in Group F.

Group D: acrylic acid, methacrylic acid, maleic acid, hydroxyethyl methacrylate, hydroxypropyl acrylate, glycidyl methacrylate, glycidyl acrylate, alkoxymethylolacrylamide, allyl alcohol Group E: styrene, vinyltoluene, methylstyrene, acrylonitrile, methacrylonitrile Group F: methyl acrylate, ethyl acrylate, butyl acrylate, 2-ethylhexyl acrylate, methyl methacrylate, ethyl methacrylate, butyl methacrylate, cyclohexyl methacrylate, stearyl methacrylate.

High molecular weight polymers used in the toner of this invention are those having a glass transition point of about 35° to 60° C. and a weight average molecular weight of more than about 500,000 to about 4,000,000 (measured removing insoluble and non-molten materials). Suitable examples of high molecular weight polymers which can be used in the toner of this invention are styrene-butadiene copolymers, acrylic-type polymers, and those as disclosed in U.S. Pat. No. 3,941,898. Suitable acrylic-type polymers used are terpolymers comprising a vinyl based monomer (such as those exemplified for Group E above), an acrylic acid ester or a methacrylic acid ester (such as those exemplified for Group F above), and a glycidyl group-containing monomer (such as glycidyl methacrylate, glycidyl acrylate, glycidyl p-vinylcarbanylate, p-glycidyl α-methylstyrene, p-glycidyl styrene, glycidyl vinylsulfone, glycidyl vinyl ether, allyl glycidyl sulfone, glycidyl allyl ether, etc.). The high molecular weight polymer is preferably a copolymer and cross-linked.

In the toners of this invention, an appropriate pigment or dye can be used as a colorant for the toner powder. For example, the following known toner colorants can be used: carbon black, Nigrosine dye, Aniline Blue, Alcohol Oil Blue, Chrome Yellow, Ultramarine Blue, Monoline Yellow, Methylene Blue Chloride, Phthalocyanine Blue, Malachite Green Oxalate, Lamp Black, Rose Bengale, and mixtures thereof. This pigment or dye should be present in the toner in an amount sufficient to highly color the toner so that a clearly visible image be formed on paper. Thus, for example, where a Xerographic copy of a printed document is desired, a black pigment such as carbon black or a black dye such as Amaplast black dye can be used. The pigment is desirably used in an amount of about 3 to 20% by weight based on the total weight of the colored toner. When the toner colorant used is a dye, it is sufficient to add it in a quite small amount.

The toner compositions of this invention can be prepared by any known toner mixing procedures or pulverization procedures. For example, all components are compounded each in the predetermined amount, mixed and pulverized to fully mix all the components, and the resulting mixture is then finely pulverized. In another known procedure, a colorant, a resin, and a solvent are ball-milled and the resulting toner mixture is spray-dried.

In the application of the electrophotographic toner compositions of this invention by the cascade developing process, the magnetic brush developing process, the C-shell developing process or others, the average particle size expressed in weight percent of the composition should be less than about 30 microns. For obtaining the best results, the average particle size is desirably in the range of about 4 to 20 microns. When the toner compositions are applied by the powdery mica developing process, the particle diameter is desirably slightly smaller than 1 micron.

Coated carriers or uncoated carriers used in the cascade developing process, the magnetic brush developing process, the C-shell developing process or others are well known. As long as the toner powder, when brought in intimate contact with carrier particles so that it attaches to the carrier particles and wraps them, gets the opposite electric charge of the carrier particle, these carrier particles can be formed from any appropriate material. Therefore, the toner compositions of this invention can be used in admixture with conventional carriers in order to develop an electrostatic latent image on the surface of a member including a conventional photoconductive surface.

The following examples are given to illustrate embodiments of the toner compositions of this invention, but this invention is not intended to be limited thereto. The excellent effect and action of the toners of this invention are made more clear by the following examples and comparative examples.

COMPARATIVE EXAMPLE 1

90 parts by weight of a polyester resin comprising bisphenol A and maleic anhydride (glass transition point: 50° C.; melt index (110° C.): 100; number average molecular weight: 2,000) and 10 parts by weight of carbon black (trade name: Black Pearls L) were fully mixed, injected into an intensive mixer at an oil pressure of 7 kg/cm$^2$ and compressor pressure of 5.0 kg/cm$^2$ and kneaded at a temperature within the mixer of 80° C. for 5 minutes.

The mixture was taken out of the mixer, cooled, appropriately divided, pulverized with a free mill to several hundred microns, and then finely pulverized by means of a jetmizer (produced by Japan Pneumatic Industrial Co., Ltd.) at an air pressure of 6.3 kg/cm$^2$ and a feed rate of 1.2 kg/hr to form a fine powder of an average particle size of 12μ.

The thus-obtained toners were mixed with DSP iron powder carriers (produced by Dowa Iron Powder Co., Ltd.), and their fixing point (the temperature at which a toner image is completely fixed) and offset point (the temperature at which offset takes place) were measured on a 720 type Xerox copying apparatus. The fixing point was found to be 125° C., and thus, the fixation was achieved at markedly low temperatures. However, the offset phenomenon was observed at as low temperatures as 135° C.

COMPARATIVE EXAMPLE 2

90 parts by weight of an epoxy resin E-1004 (produced by Shell Chemical Co., Ltd.) and 10 parts by weight of carbon black were fully mixed, injected into an intensive mixer at an oil pressure of 7.0 kg/cm$^2$ and kneaded at a temperature within the mixer of 80° C. for 5 minutes.

The mixture was taken out of the mixer, cooled, appropriately divided, pulverized with a free mill to several hundred microns, and then finely pulverized by means of a jetmizer at an air pressure of 6.3 kg/cm$^2$ and a feed rate of 2.0 kg/hr to form a fine powder of an average particle size of 12μ.

The thus-obtained toners were mixed with DSP iron powder carriers and their fixing point and offset point were measured on a 720 type Xerox copying apparatus. The fixing point was found to be 130° C. and thus the fixation was achieved at markedly low temperatures. However, the offset phenomenon was observed at as low temperatures as 140° C.

COMPARATIVE EXAMPLE 3

90 parts by weight of a styrene-allyl alcohol copolymer RP-450 (produced by Shell Chemicals Co., Ltd., glass transition point: 50° C.; number average molecular weight: 1150) and 10 parts by weight of carbon black were fully mixed, injected into an intensive mixer at an oil pressure of 7.0 kg/cm$^2$ and a compressor pressure of 5.0 kg/cm$^2$ and kneaded at a temperature within the mixer of 80° C. for 5 minutes.

The mixture was taken out of the mixer, cooled, appropriately divided, pulverized with a free mill to several hundred microns and then finely pulverized by means of a jetmizer at an air pressure of 6.3 kg/cm$^2$ and a feed rate of 5 kg/hr to form a fine powder of an average particle size of 12μ.

The thus-obtained toners were mixed with DSP iron powder carriers and their fixing point and offset point were measured on a 720 type Xerox copying apparatus. The fixing point was found to be 120° C. and thus the fixation was achieved at markedly low temperatures. However, the offset phenomenon was observed at as low temperatures as 130° C.

EXAMPLE 1

63 parts by weight of a polyester resin comprising bisphenol A and maleic anhydride (glass transition point: 50° C.; melt index (110° C.): 100; number average molecular weight: 2,000), 27 parts by weight of a styrene-butadiene copolymer (number average molecular weight: 20,000; weight average molecular weight: 1,500,000; glass transition point: 40° C.) and 10 parts by weight of carbon black were fully mixed, injected into an intensive mixer at an oil pressure of 7.0 kg/cm$^2$ and a compressor pressure of 5.0 kg/cm$^2$ and kneaded at a temperature within the mixer of 80° C. for 5 minutes.

The mixture was taken out of the mixer, cooled, appropriately divided, pulverized with a free mill to several hundred microns and then finely pulverized by means of a jetmizer at an air pressure of 6.3 kg/cm$^2$ and a feed rate of 1.0 kg/hr to form a fine powder having an average particle size of 12$\mu$.

The thus-obtained toners were mixed with DSP iron powder carriers and their fixing point and offset point were measured on a 720 type Xerox copying apparatus as above. The fixation was achieved at quite a low temperature of 125° C., and no offset phenomenon was observed until 200° C.

EXAMPLE 2

54 parts by weight of an epoxy resin E-1004, 36 parts by weight of a styrene-butadiene copolymer (number average molecular weight: 15,000; weight average molecular weight: 2,000,000; glass transition point: 40° C.), and 10 parts by weight of carbon black were fully mixed, injected into an intensive mixer at an oil pressure of 7.0 kg/cm$^2$ and a compressor pressure of 5.0 kg/cm$^2$ and kneaded at a temperature within the mixer of 80° C. for 5 minutes.

The mixture was taken out of the mixer, cooled, appropriately divided, pulverized with a free mill to several hundred microns and then finely pulverized by means of a jetmizer at an air pressure of 6.3 kg/cm$^2$ and a feed rate of 1.4 kg/hr to form a fine powder having an average particle size of 12$\mu$.

The thus-obtained toners were mixed with DSP iron powder carriers and their fixing point and offset point where measured on a 720 type Xerox copying apparatus as above. The fixation was fully achieved at 135° C. and no offset was observed until 200° C.

EXAMPLE 3

63 parts by weight of a styrene-allyl alcohol copolymer RP-450, 27 parts by weight of a styrene-butadiene copolymer (number average molecular weight: 18,000; weight average molecular weight: 2,300,000; glass transition point: 40° C.), and 10 parts by weight of carbon black were fully mixed, injected into an intensive mixer at an oil pressure of 7.0 kg/cm$^2$ and a compressor pressure of 5.0 kg/cm$^2$, and kneaded at a temperature within the mixer of 80° C. for 5 minutes.

The mixture was taken out of the mixer, cooled, appropriately divided, pulverized with a free mill to several hundred microns and then finely pulverized by means of a jetmizer at an air pressure of 6.3 kg/cm$^2$ and a feed rate of 3.5 kg/hr to form a fine powder having an average particle size of 12$\mu$.

The thus-obtained toners were mixed with DSP iron powder carriers and their fixing point and offset point were measured on a 720 type Xerox copying apparatus as above. The fixation was completely ahcieved at 120° C. and no offset was observed until 180° C.

EXAMPLE 4

27 parts by weight of a styrene-allyl alcohol copolymer RP-450, 27 parts by weight of a polyester resin (produced from bisphenol A and maleic anhydride; glass transition point: 50° C.; melt index (110° C.): 100; number average molecular weight: 2,000), 36 parts by weight of a styrene-butadiene copolymer (number average molecular weight: 20,000; weight average molecular weight: 4,000,000; glass transition point: 40° C.), and 10 parts by weight of carbon black were fully mixed, injected into an intensive mixer at an oil pressure of 7.0 kg/cm$^2$ and a compressor pressure of 5.0 kg/cm$^2$, and kneaded at a temperature within the mixer of 80° C. for 5 minutes.

The mixture was taken out of the mixer, cooled, appropriately divided, pulverized with a free mill to several hundred microns, and then finely pulverized by means of a jetmizer at an air pressure of 6.3 kg/cm$^2$ and a feed rate of 2.0 kg/hr to form a fine powder having an average particle size of 12$\mu$.

The thus-obtained toners were mixed with DSP iron powder carriers and their fixing point and offset point were measured on a 720 type Xerox copying apparatus as above. The fixation was completely achieved at 125° C. and no offset phenomenon was observed until 200° C.

EXAMPLE 5

27 parts by weight of a styrene-allyl alcohol copolymer RP-450, 27 parts by weight of an epoxy resin E-1004, 36 parts by weight of a styrene-butadiene copolymer (number average molecular weight: 20,000; weight average molecular weight: 4,000,000; glass transition point: 40° C.) and 10 parts by weight of carbon black were fully mixed, injected into an intensive mixer at an oil pressure of 7.0 kg/cm$^2$ and a compressor pressure of 5.0 kg/cm$^2$, and kneaded at a temperature within the mixer of 80° C. for 5 minutes.

The mixture was taken out of the mixer, cooled, appropriately divided, pulverized with a free mill to several hundred microns and then finely pulverized by means of a jetmizer at an air pressure of 6.3 kg/cm$^2$ and a feed rate of 2.5 kg/hr to form a fine powder having an average particle size of 12$\mu$.

The thus-obtained toners were mixed with DSP iron powder carriers and their fixing point and offset point were measured on a 720 type Xerox copying apparatus as above. The fixation was completely achieved at 130° C. and no offset phenomenon was observed until 190° C.

Although the present invention was explained in detail by reference to the preferred embodiments thereof, it goes without saying that various modifications and improvements can be made within the concept and scope of this invention.

What is claimed is:

1. An electrophotographic toner for heat roll fixation comprising a binder resin and a colorant dispersed therein wherein the binder resin comprises about 50 to 95% by weight of a low temperature melting, high fluidity resin selected from the group consisting of a polyester resin, an epoxy resin, and a vinyl polymer and having a number average molecular weight of about 1,000 to 4,000, a glass transition temperature of about 40° to 60° C. and a melt index at 110°. C. of about 50 to 200 g/10 min or a mixutre thereof, and about 5 to 50% by weight of a high molecular weight polymer selected from the group consisting of an acrylic-type polymer and a styrene based polymer and having a glass transition temperature of about 35° to 60° C. and a weight average molecular weight of more than about 500,000.

2. The electrophotographic toner of claim 1, wherein said low temperature melting, high fluidity resin is a polyester resin which is the reaction product of a divalent alcohol selected from the group consisting of ethyleneglycol, triethyleneglycol, 1,2-propyleneglycol, 1,3-propyleneglycol, 1,4-butanediol, neopentylglycol, 1,4-butenediol, 1,4-bis(hydroxymethyl)cyclohexane, bisphenol A, hydrogenated bisphenol A and polyoxyethylenated bisphenol A; a dibasic acid selected from the group consisting of maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid and malonic acid, or acid anhydrides or lower alcohol esters thereof; and, optionally, a member selected from the group consisting of glycerin, trimethanolpropane, pentaerythritol, trimellitic acid and pyromellitic acid.

3. The electrophotographic toner of claim 1, wherein said low temperature melting, high fluidity resin is an epoxy resin.

4. The electrophotographic toner of claim 1, wherein said low temperature melting, high fluidity resin is a vinyl polymer which is the reaction product of a functional group-containing monomer selected from the group consisting of acrylic acid, methacrylic acid, maleic acid, hydroxyethyl methacrylate, hydroxypropyl acrylate, glycidyl methacrylate, glycidyl acrylate, alkoxymethylolacrylamide and allyl alcohol; a monomer selected from the group consisting of styrene, vinyltoluene, methylstyrene, acrylonitrile and methylacrylonitrile; and, optionally, a monomer selected from the group consisting of methyl acrylate, ethyl acrylate, butyl acrylate, 2-ethylhexyl acrylate, methyl methacrylate, ethyl methacrylate, butyl methacrylate, cyclohexyl methacrylate and stearyl methacrylate.

5. The electrophotographic toner of claim 1, wherein said high molecular weight polymer has a weight average molecular weight of up to about 4,000,000.

6. The electrophotographic toner of claim 1, wherein said colorant is a pigment or a dye.

7. The electrophotographic toner of claim 1, wherein said colorant is a pigment present in an amount of about 3 to 20% by weight based on the total weight of the toner.

8. The electrophotographic toner of claim 1, wherein said toner has an average particle size expressed in weight % of the composition of less than about 30 microns.

9. The electrophotographic toner of claim 8, wherein said average particle size is about 4 to 20 microns.

10. The electrophotographic toner of claim 1, wherein said high molecular weight polymer is a cross-linked polymer.

11. The electrophotographic toner of claim 1, wherein said acrylic-type polymer is a terpolymer of a monomer containing a vinyl group, an acrylic or methacrylic acid ester, and a monomer containing a glycidyl group.

* * * * *